US005419385A

United States Patent [19]

Vogel et al.

[11] Patent Number: 5,419,385

[45] Date of Patent: May 30, 1995

[54] DOUBLE SHEET LIGHT CONTROL WINDOW COVERING WITH UNIQUE VANES

[75] Inventors: David Vogel, Thornton; James H. Sealey, Westminster, both of Colo.

[73] Assignee: Hunter Douglas, Inc., Upper Saddle River, N.J.

[21] Appl. No.: 99,700

[22] Filed: Jul. 29, 1993

[51] Int. Cl.[6] ..... E06B 9/08

[52] U.S. Cl. ..... 160/121.1

[58] Field of Search ..... 160/121.1, 84.1 D, 166.1, 160/89, DIG. 7

[56] References Cited

U.S. PATENT DOCUMENTS

| | | | |
|---|---|---|---|
| Re. 30,254 | 4/1980 | Rasmussen . | |
| 1,937,342 | 11/1933 | Higbie . | |
| 2,029,675 | 2/1936 | Schlamp . | |
| 2,110,145 | 3/1938 | Loehr . | |
| 2,140,049 | 12/1938 | Grauel . | |
| 2,620,850 | 12/1952 | Janowski . | |
| 2,856,324 | 10/1958 | Janowski . | |
| 2,865,446 | 12/1958 | Cole . | |
| 2,914,122 | 11/1959 | Pinto . | |
| 3,032,099 | 5/1962 | Croxen . | |
| 3,111,163 | 11/1963 | Nelson . | |
| 3,384,519 | 5/1968 | Froget . | |
| 3,661,665 | 5/1972 | Froget . | |
| 3,844,330 | 10/1974 | Hyman . | |
| 3,851,699 | 12/1974 | Shapiro . | |
| 4,019,554 | 4/1977 | Rasmussen . | |
| 4,039,019 | 8/1977 | Hopper . | |
| 4,137,111 | 1/1979 | Hansen . | |
| 4,194,550 | 3/1980 | Hopper . | |
| 4,344,474 | 8/1982 | Berman . | |
| 4,450,027 | 5/1984 | Colson . | |
| 4,535,828 | 8/1985 | Brockhaus . | |
| 4,685,986 | 8/1987 | Anderson . | |
| 4,826,555 | 5/1989 | Long . | |
| 4,884,612 | 12/1989 | Schnebly et al. . | |
| 4,928,369 | 5/1990 | Schnebly et al. . | |
| 4,984,617 | 1/1991 | Corey | 160/84.1 D |
| 5,193,601 | 3/1993 | Corey et al. | 160/84.1 D |
| 5,228,936 | 7/1993 | Goodhue . | |
| 5,287,908 | 2/1994 | Hoffmann et al. | 160/121.1 |
| 5,313,999 | 5/1994 | Colson et al. | 160/121.1 |
| 5,320,154 | 6/1994 | Colson et al. | 160/121.1 |

FOREIGN PATENT DOCUMENTS

| | | |
|---|---|---|
| 24985 | 5/1963 | Australia . |
| 29442 | 6/1981 | European Pat. Off. . |
| 1166398 | 6/1958 | France . |
| 1309194 | 10/1962 | France . |
| 1321456 | 2/1963 | France . |
| 1364674 | 5/1964 | France . |
| 1373515 | 8/1964 | France . |
| 1381472 | 11/1964 | France . |
| 1465261 | 11/1966 | France . |
| 1480262 | 4/1967 | France . |
| 1521488 | 3/1968 | France . |
| 1526507 | 4/1968 | France . |
| 1585159 | 12/1969 | France . |
| 2398170 | 2/1979 | France . |
| 382758 | 10/1923 | Germany . |
| 684202 | 11/1939 | Germany . |
| 1241361 | 5/1967 | Germany . |
| 1942674 | 3/1970 | Germany . |
| 7008554 | 10/1971 | Germany . |
| 2735654 | 2/1979 | Germany . |
| 2923233 | 12/1980 | Germany . |
| 2936811 | 4/1981 | Germany . |
| 3525515 | 1/1987 | Germany . |
| 8906284 | 8/1989 | Germany . |
| 7805464 | 10/1978 | Netherlands . |
| 331432 | 9/1958 | Switzerland . |
| 423207 | 10/1966 | Switzerland . |
| 476482 | 9/1969 | Switzerland . |
| 494338 | 9/1970 | Switzerland . |
| 1036126 | 7/1966 | United Kingdom . |
| 1228677 | 4/1971 | United Kingdom . |

*Primary Examiner*—David M. Purol

*Attorney, Agent, or Firm*—Gary M. Polumbus; Holland Hart

[57] ABSTRACT

A window covering consisting of spaced sheets of translucent or transparent material interconnected by vanes wherein the vanes may be configured in non-rectangular patterns. Elongated vanes having scalloped edges may be utilized or a plurality of smaller individual vanes connected between the sheets of material randomly or in rows may also be utilized. In a closed condition of the window covering, the vanes extend substantially parallel to the sheets of material and usually overlap to block the passage of light therethrough whereas, in an open condition the vanes predominantly extend substantially perpendicularly to the sheets of material to permit the passage of light therethrough.

52 Claims, 13 Drawing Sheets

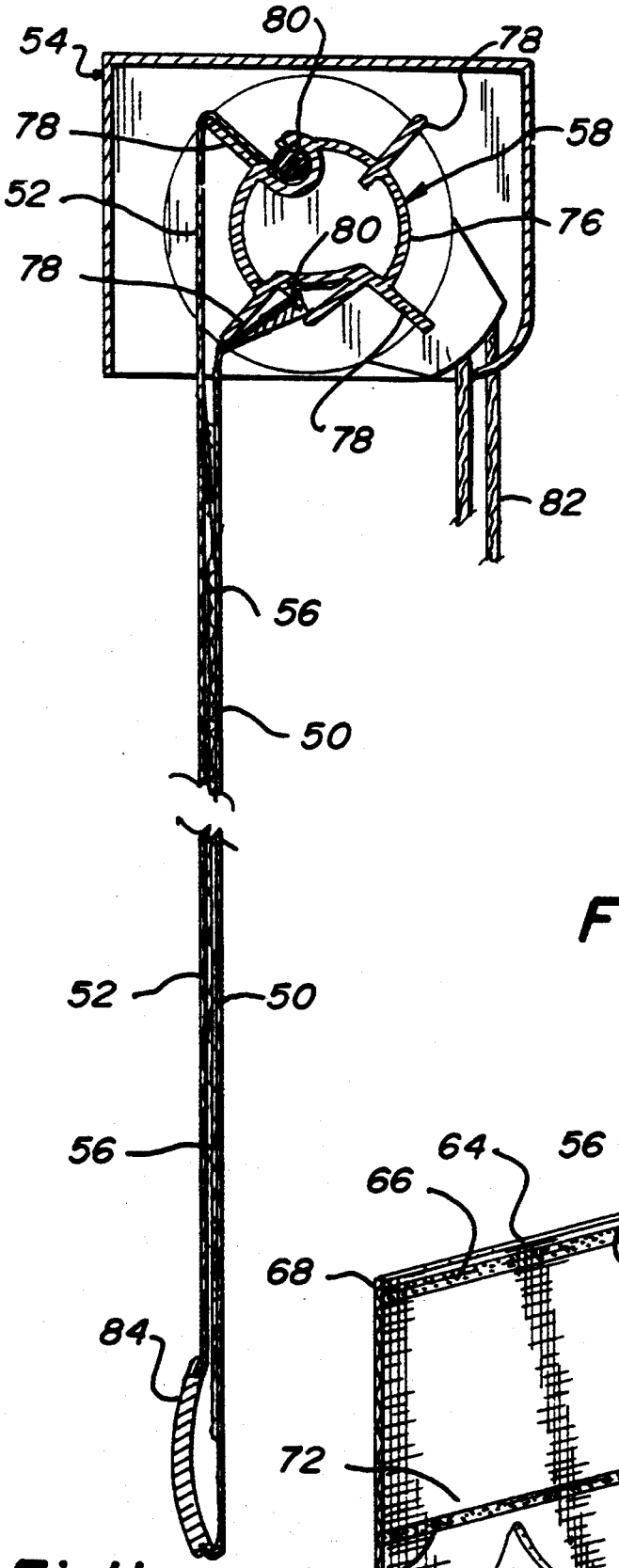
Fi_11
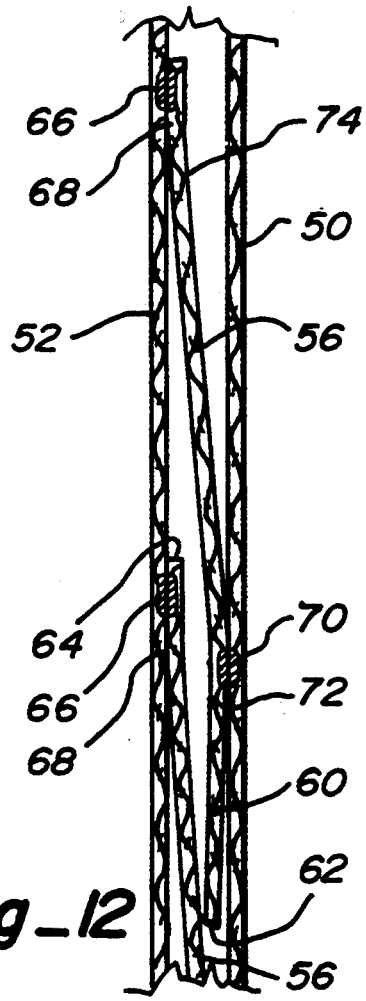
Fig_12
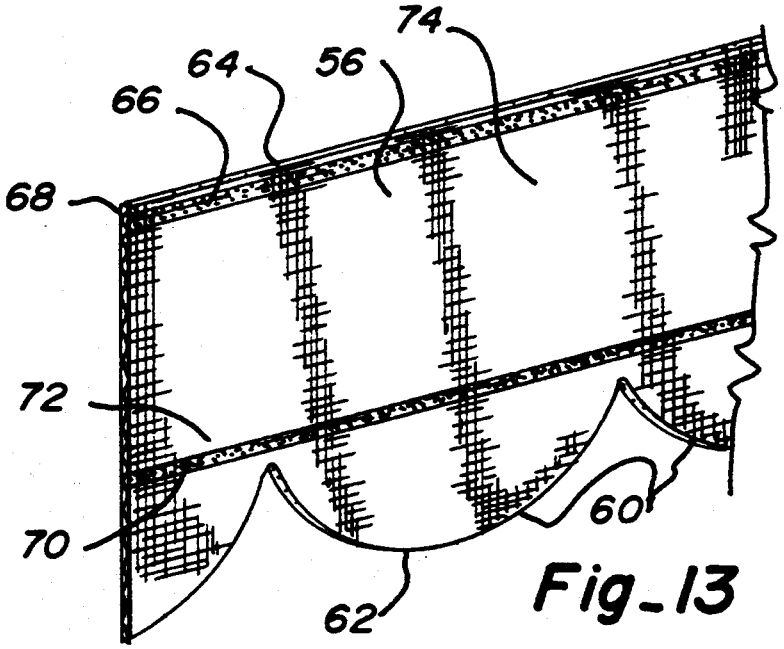
Fig_13

DOUBLE SHEET LIGHT CONTROL WINDOW COVERING WITH UNIQUE VANES

BACKGROUND OF THE INVENTION

1. Field of the Invention

The present invention relates generally to window coverings and more particularly to fabric type window coverings provided with unique vanes for controlling the amount of light passing therethrough.

2. Description of the Prior Art

Fabric window coverings are often preferred by consumers for a number of their features. The features most often considered desirable are the softer appearance relative to traditional venetian blinds, the uniform appearance which they provide a window and insulating properties associated with cellular fabric shades.

Cellular fabric shades offering these features are known in the art. For example, U.S. Pat. No. 4,450,027 to Colson discloses cellular window coverings which may be made of fabric or film materials. In the process disclosed in the Colson patent, a flexible strip of material is folded into a continuous longitudinal tube and the longitudinal folds thus created are permanently set by passing the tubing material around a heat setting wheel. Adhesive is applied along one side of the flattened tubular material which is subsequently stacked by winding onto a rack having flat surfaces. The winding in this manner presses the adhesive to the next layer wound onto the rack to form a bonded unitary stack of closed tubular cells. When the ends are cut from the rack, the stack may be expanded and the permanently set creases provide a neat and uniform outward appearance.

U.S. Pat. No. 4,732,630 to Schnebly discloses a modification to the Colson process described above. In the Schnebly patent, a hot melted adhesive is applied to one side of the tubular material. After the flat tubular strips have been stacked and cut, they are placed in an oven under pressure and the hot melted adhesive is activated to bond the layers together.

Both of the above patents disclose window coverings which exhibit the desirable features discussed to this point. However, window coverings of that type lack one feature which is often desired by consumers. That feature is the ability to control the amount of light admitted through the window covering, similar to a traditional venetian blind. There have been some attempts to provide a fabric window covering with the ability to control the amount of light entering the room.

U.S. Pat. No. 3,384,519 to Froget discloses one such attempt. The window covering disclosed therein consists of two cloth layers spaced apart by moveable parallel and flexible fabric blades having each of their marginal edges heat welded to one of the moveable cloth layers. With this window covering, relative movement of the two cloth layers in a direction perpendicular to the blades changes the angle of the blades and thus controls the amount of light admitted through the covering. A number of undesirable features of the Froget window covering derive from the fact that it is constructed utilizing a heat welding process. First, this limits the fabric which may be utilized to thermoplastic materials. Also, heat welding necessarily requires a melting of at least some of the fibers of the materials bonded, thus providing an uneven outer appearance along the heat weld and producing unwanted crimps or creases in the materials which can result in failure of the fabric fibers. Further, heat welding is a relatively slow process which may require six or more seconds to create a bond over an extended length. This is too slow for application in high volume commercial production processes. Other drawbacks of the Froget window covering are that heat welds are limited in strength and it is difficult to achieve uniformly straight heat welded points over an extended length.

U.S. Pat. No. 2,865,446 to Cole discloses a window covering in which a long rectangular piece of fabric is doubled back upon itself and a plurality of pleated elements are placed between the folded over sheets. The pleated elements are an accordion pleated fabric which extends when the two sides of the folded over fabric are moved relative to one another in a direction perpendicular to the accordion pleats. Such a window covering does not provide the uniform appearance because the accordion pleated fabric located close to the top of the window covering does not expand to the same extent as the fabric closer to the bottom of the window covering. Also, it is very difficult to insure that such accordion pleated fabric returns to its desired position after each expansion.

French Patent No. 1,309,194 discloses a curtain with variable opacity. In this curtain, screen or mesh parallel sides are provided with tiltable braids therebetween. The braids are said to be attached at their edges to the sides. However, no means for attachment is specified. The drawings appear to indicate a hinged type attachment and the specification ends by stating that the difficulties of construction are substantial.

U.S. Pat. No. 3,851,699 issued to Shapiro discloses a vertical louver-type window drape wherein a continuous sheet of fabric material is interwoven with a plurality of relatively rigid vanes such that the vanes which are light impeding alternate with light transmitting sections of the fabric. One obvious drawback with a system of this type is that the vanes overlap the fabric requiring excessive fabric in order to fabricate the entire window covering. Further, the vanes or louvers are only attached to the fabric material along a top and bottom edge thereof, thereby inhibiting the control over the fabric material during operation of the window covering.

As will be appreciated from prior art window coverings wherein vanes are disposed between sheets of transparent or translucent material, the vanes are of rectangular planar configuration whether they are rigid or made of a flexible fabric material. Since window coverings of this type are to a large degree design oriented, the limitation of rectangular vanes limits the possible aesthetic variations consistent with retaining the desired utilitarian qualities of such window coverings.

It is to provide alternatives to prior art window coverings of this general type while maintaining the desirable utilitarian functions that the present invention has been made.

SUMMARY OF THE INVENTION

The window covering of the present invention is of the general type wherein a pair of fabric sheets are suspended vertically in a parallel orientation and interconnected at spaced intervals by parallel vanes. Typically, the sheets of material are transparent or translucent while the vanes have some degree of opacity. When the window covering is in an open position, the vanes extend substantially perpendicularly to the sheets of material such that light is allowed to pass through the window covering but in a closed position, the sheets are shifted such that the vanes extend substantially parallel to the sheets to substantially block the passage of light therethrough.

In one embodiment of the invention, the vanes have at least one scalloped edge and are bonded to the sheets such that a bond line adjacent the scalloped edge of the vane is disposed inwardly from that edge of the vane so that the scallops, thereby establish a valance like appearance and extend in parallel relationship with the sheet material regardless of whether or not the window covering is in its open or closed position. The scallops may take any one of numerous geometric or other configurations for aesthetic purposes.

In a second embodiment of the invention, the vanes are similarly configured to the first embodiment. The scalloped edge of each vane, however, is bonded to the associated sheet of material at spaced intervals such that in the open condition of the window covering, the scallops are not readily visible but when the window covering is closed, the scallops are visible through the fabric sheets.

In a third embodiment, the vanes consist of smaller independent pieces of material which can be configured in many variations and with the individual vanes being bonded to the sheets in side by side relationship. As will be appreciated with the description that follows, the sheets of translucent or transparent material are quadrilateral thereby having two pairs of parallel side edges and the vanes are of a size such that their dimensions are smaller than the distance between the side edges of the sheets whereby a plurality of the vanes can be disposed between parallel side edges. The individual vanes may be arranged in parallel rows or randomly. When the vanes are arranged in parallel rows, they are bonded to the sheets of material along discontinuous bond lines and preferably the vanes in each row are staggered relative to the vanes in the next adjacent row such that when the window covering is moved into its closed position, the vanes will overlap each other thereby blocking light from passage through the window covering. The vanes can be oriented horizontally or vertically. As will be appreciated, this embodiment of the invention while retaining most of the utilitarian functions of the first and second embodiments creates a quite unique visual appearance. Again, the vanes can each be configured in many different geometric or other configurations.

Other aspects, features and details of the present invention can be more completely understood by reference to the following detailed description of a preferred embodiment, taken in conjunction with the drawings, and from the appended claims.

BRIEF DESCRIPTION OF THE DRAWINGS

FIG. 11 is an enlarged fragmentary section taken along line 11—11 of FIG. 2.

FIG. 12 is an enlarged fragmentary side elevation of the window covering as shown in FIG. 2 and 11.

FIG. 13 is a fragmentary isometric of a vane as it would look with the window covering as shown in FIG. 2 and 11.

DESCRIPTION OF THE PREFERRED EMBODIMENTS

Figure 1:
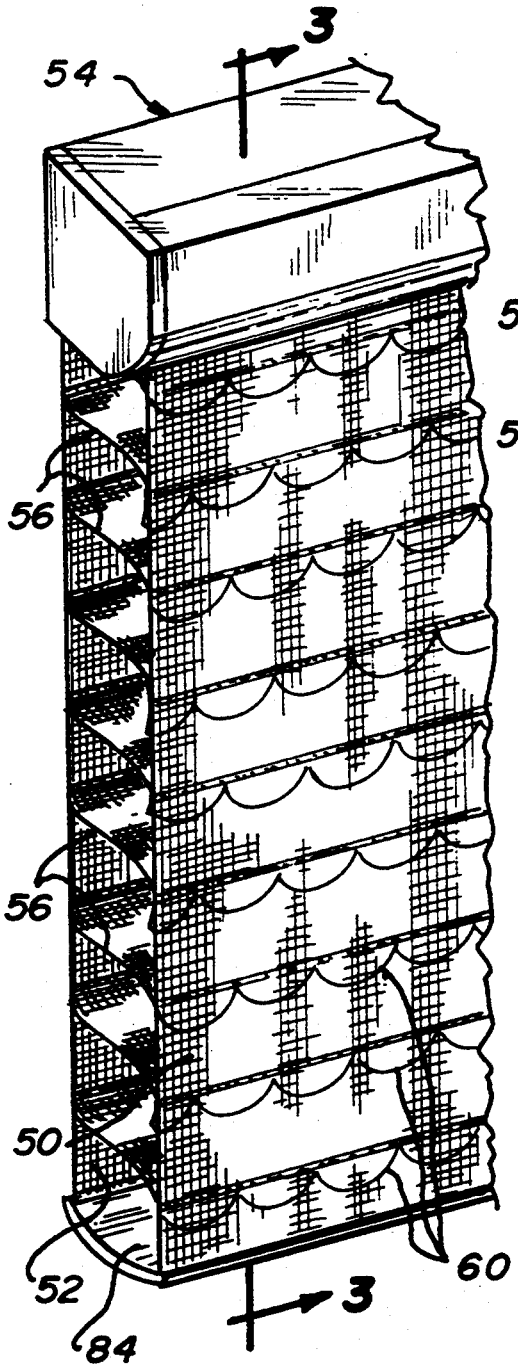
FIG. 1 is a fragmentary isometric view of a window covering fabricated in accordance with the first embodiment of the present invention and shown in an open condition.
Figure 2:
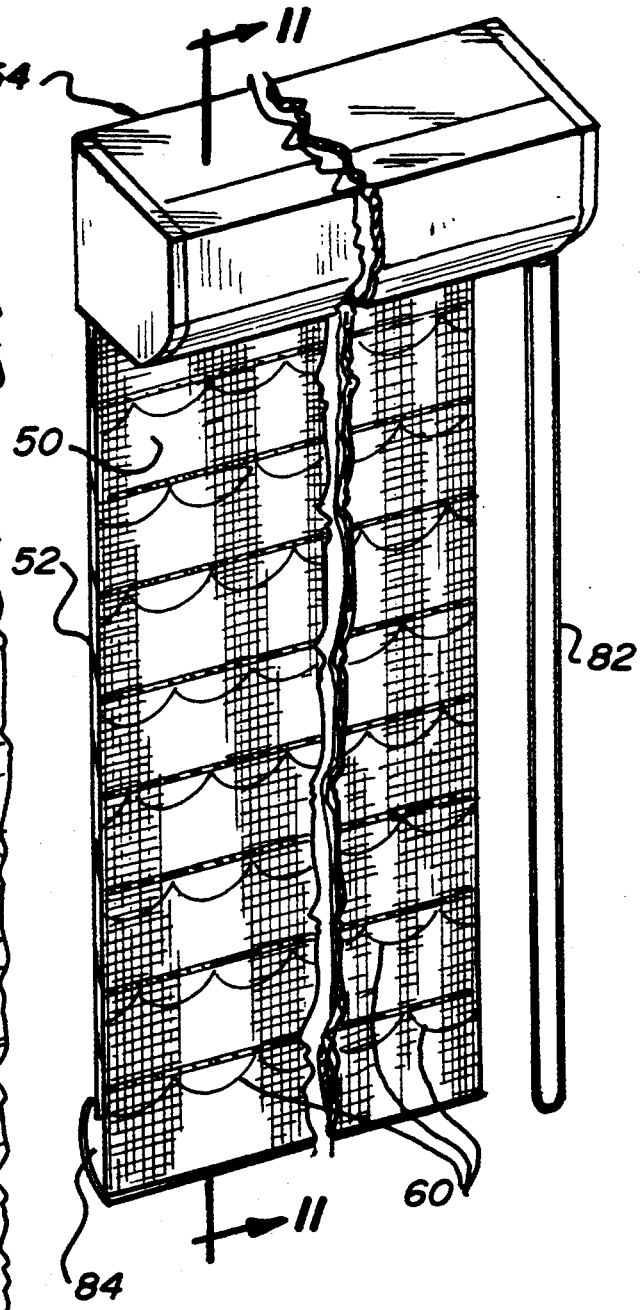
FIG. 2 is a fragmentary isometric: view of a window covering fabricated in accordance with the first embodiment of the present invention and shown in a closed position.
Figure 3:
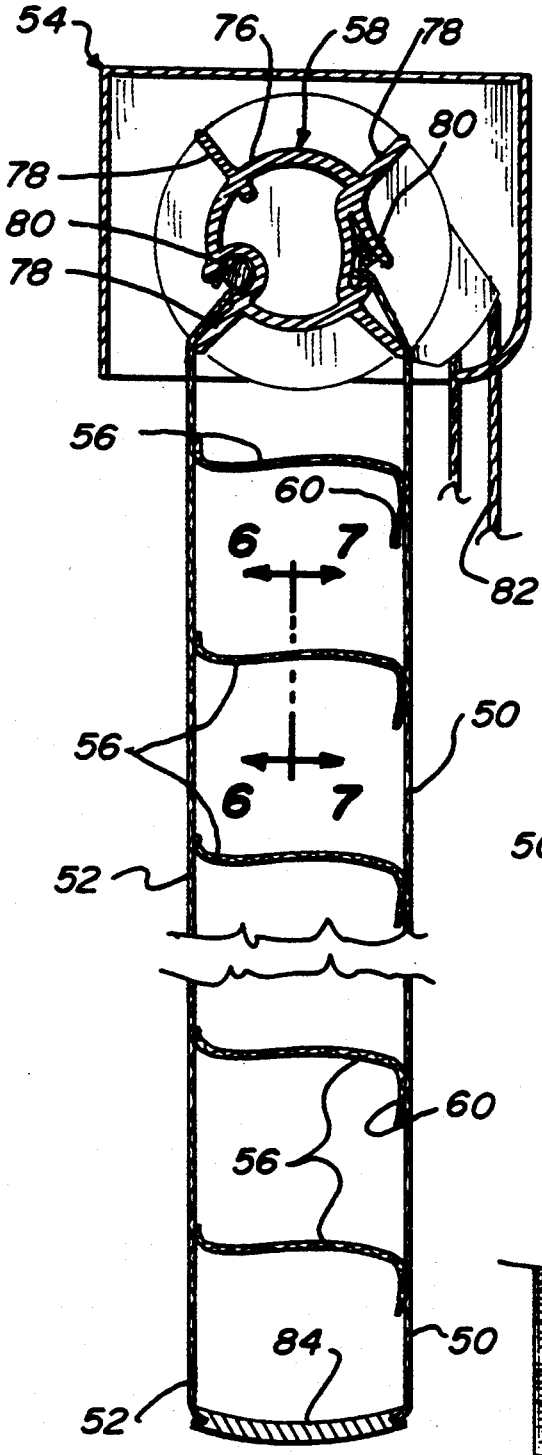
FIG. 3 is an enlarged fragmentary section taken along line 3—3 of FIG. 1.
Figure 4:
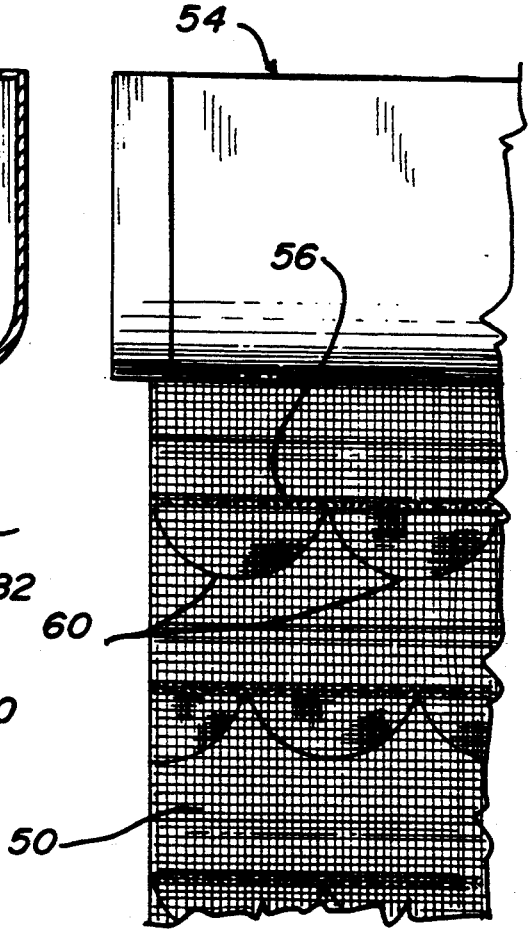
FIG. 4 is a fragmentary front elevation of the window covering as shown in FIG. 1.
Figure 5:
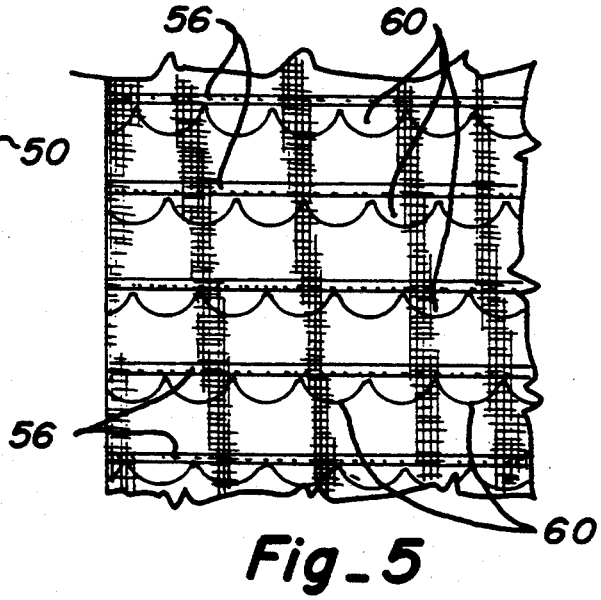
FIG. 5 is a fragmentary front elevation of the window covering as shown in FIG. 2.
Figure 6:
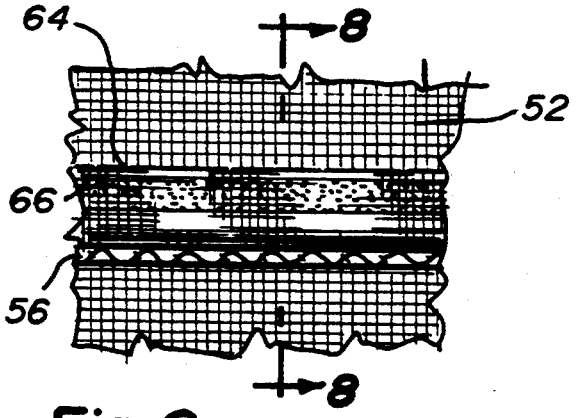
FIG. 6 is an enlarged fragmentary section taken along line 6—6 of FIG. 3.
Figure 8:
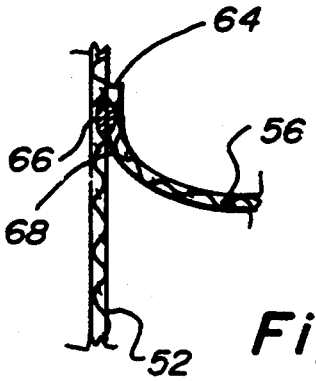
FIG. 8 is a fragmentary section taken along line 8—8 of FIG. 6.
Figure 7:
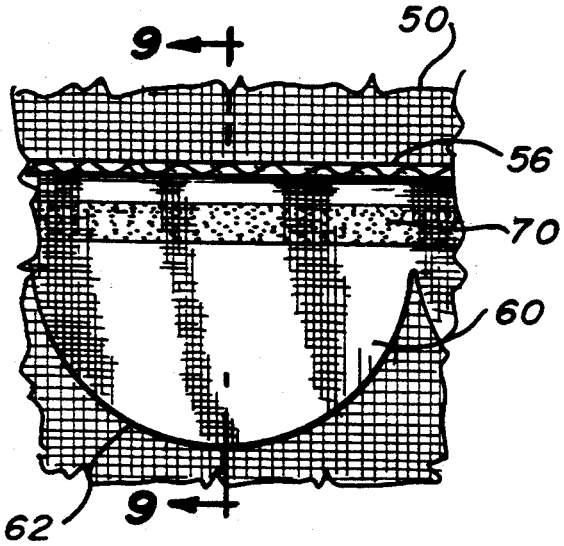
FIG. 7 is an enlarged fragmentary section taken along line 7—7 of FIG. 3.
Figure 9:
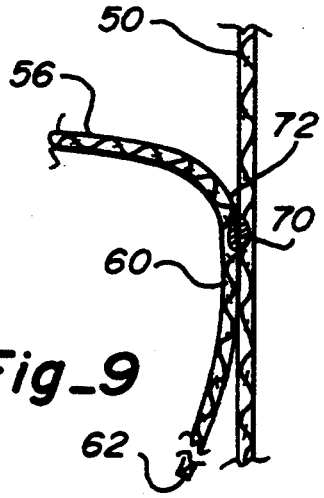
FIG. 9 is a fragmentary section taken along line 9—9 of FIG. 7.

A first embodiment of the window covering of the present invention is shown in FIGS. 1 through 13 and can be seen best in FIGS. 1 and 2 to include front and rear fabric sheets 50 and 52, respectively, suspended from a head rail 54 and having a plurality of horizontally disposed and vertically spaced vanes 56 interconnecting the sheets 50 and 52. A conventional control mechanism 58, partially shown in FIGS. 3 and 11, is provided in the head rail 54 for vertically shifting the sheets in opposite directions to move the window covering between an open condition illustrated in FIG. 1 and a closed position illustrated in FIG. 2. The control mechanism 58 can also be used to roll the sheets up (not shown) to remove the window covering from its normal overlying relationship with the window in which it is mounted.

The sheets 50 and 52 are preferably made of a fabric material that is either transparent or translucent, such as sheer, to transmit light and the vanes 56 are preferably made of a flexible material that has some degree of opacity and may also be fabric. Accordingly, when the window covering is in the open condition of FIG. 1, the vanes are disposed substantially perpendicularly to the fabric sheets to which they are attached thereby permitting light to pass between the vanes and in the closed position of FIG. 2, the vanes extend substantially parallel to the fabric sheets and substantially block the passage of light through the window covering.

Figure 10:
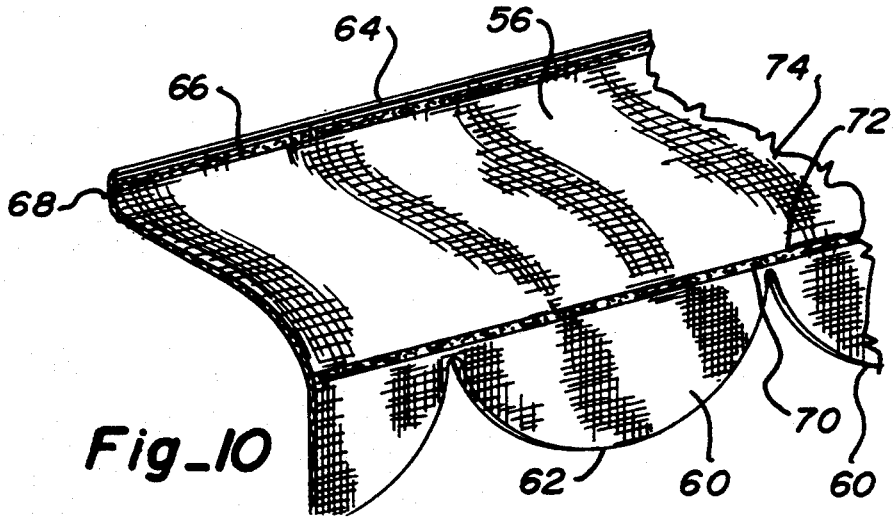
FIG. 10 is a fragmentary isometric view of a vane utilized in the first embodiment of the window covering of the present invention.

Referring next to FIG. 13, the vanes 56, which are substantially identical, can be seen to be of elongated planar configuration having a scalloped marginal zone 60 adjacent to one side edge 62. The opposite side edge 64 is straight. As possibly best appreciated by reference to FIGS. 10, 12 and 13, a continuous straight line of adhesive 66 is applied to a rear planar face 68 of each vane along its straight edge 64 and a second continuous straight line of adhesive 70 is applied to the front planar face 72 of each vane along a line that separates a main rectangular portion 74 of each vane from the scalloped marginal zone 60. The lines of adhesive are of course utilized to bond each vane to the front and rear sheets 50 and 52, respectively, so that the vanes are disposed as shown in FIGS. 11 through 13 when the window covering is closed and as shown in FIGS. 3 through 10 when the window covering is open. As will be readily appreciated, the scalloped marginal zone 60 of each vane hangs downwardly in parallel adjacent relationship to the front fabric sheet 50 in either the open or closed condition of the window covering. As will also be appreciated, and particularly as seen in FIGS. 3 and 10, the vanes in the open condition of the window covering assume a substantially S-shaped curved orientation in transverse cross-section, while in the closed position the vanes are substantially straight in transverse cross-section.

As best appreciated by reference to FIGS. 1 or 2, it will be seen that the scalloped marginal zone 60 of each vane 56 is visible through the transparent or translucent front sheet 50 irrespective of whether or not the window covering is in the open or closed position. This creates a unique aesthetic appearance while retaining the desirable utilitarian function of window coverings of the same general type wherein vanes interconnect spaced sheets of fabric material.

The control mechanism 58 for operating the window covering as mentioned previously is disposed within the head rail 54 and consists of a horizontal cylinder 76 having spaced elongated radial ribs 78 and attachment anchors 80 for securing the upper edge of each fabric sheet 50 and 52 to the cylinder. Control cords 82 are operably attached to the cylinder 76 so that the cylinder can be pivoted about its longitudinal axis between the position illustrated in FIG. 3 and the position illustrated in FIG. 11 to move the window covering between its open and closed positions. As mentioned previously, the sheets 50 and 52 can also be wrapped around the cylinder 76 by rotation of the cylinder to raise the sheets above their normal overlying relationship with the window opening in which the window covering is mounted. A more detailed description of such a control mechanism is disclosed in U.S. patent application Ser. No. 07/717,284 filed Jun. 20, 1991, the disclosure of which is hereby incorporated by reference. It should also be appreciated that a weighted bottom rail 84 interconnects each fabric sheet 50 and 52 along its lower edge to assist in retaining the sheets of fabric in a desired reasonably taut condition.

The lines of adhesive 66 and 70 used to secure the vanes to the fabric sheets are preferably a hot-melt adhesive such as of the type manufactured by EMS-American Grilon, Inc. of Charlotte, N.C., and sold under the brand name Grilltex.

The first embodiment of the present invention might also be implemented by extending the vanes vertically rather than horizontally. The control mechanism for operating a vertical arrangement could be of the type disclosed in FIGS. 3 and 4 of U.S. patent application Ser. No. 07/810,331 filed Dec. 19, 1991 for Window Covering Assembly which is of common ownership with the present application and is hereby incorporated by reference.

In a second embodiment of the window covering of the present invention illustrated in FIGS. 14 through 21, it will be seen that the window covering includes front and rear sheets 86 and 88, respectively, of fabric material such as sheer, which are interconnected along horizontal lines at vertically spaced locations by elongated flexible fabric vanes 90. The sheets are suspended from a control mechanism 92, as described in connection with the first embodiment, in a head rail 94 so that the sheets 86 and 88 can be vertically shifted in opposite directions to move the window covering between a closed position of FIG. 14 and an open position of FIG. 15. In the closed position of FIG. 14, the vanes 90 extend in a substantially parallel relationship with the front and rear sheets while in the open condition of FIG. 15, the vanes extend substantially perpendicularly to the front and rear sheets. A weighted bottom rail 96 interconnects the front and rear sheets and provides the weight necessary to retain the sheets in a reasonably taut condition.

Figure 18:
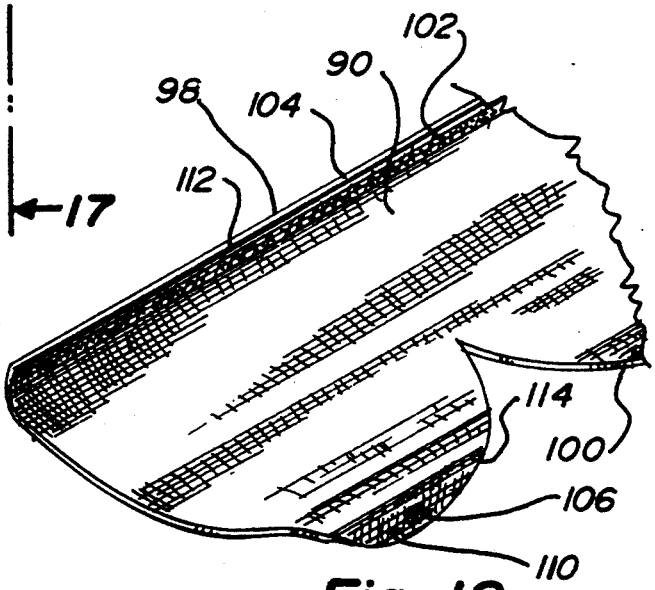
FIG. 18 is a fragmentary isometric of a vane as it would appear in an open condition of the second embodiment of the present invention.
Figure 17:
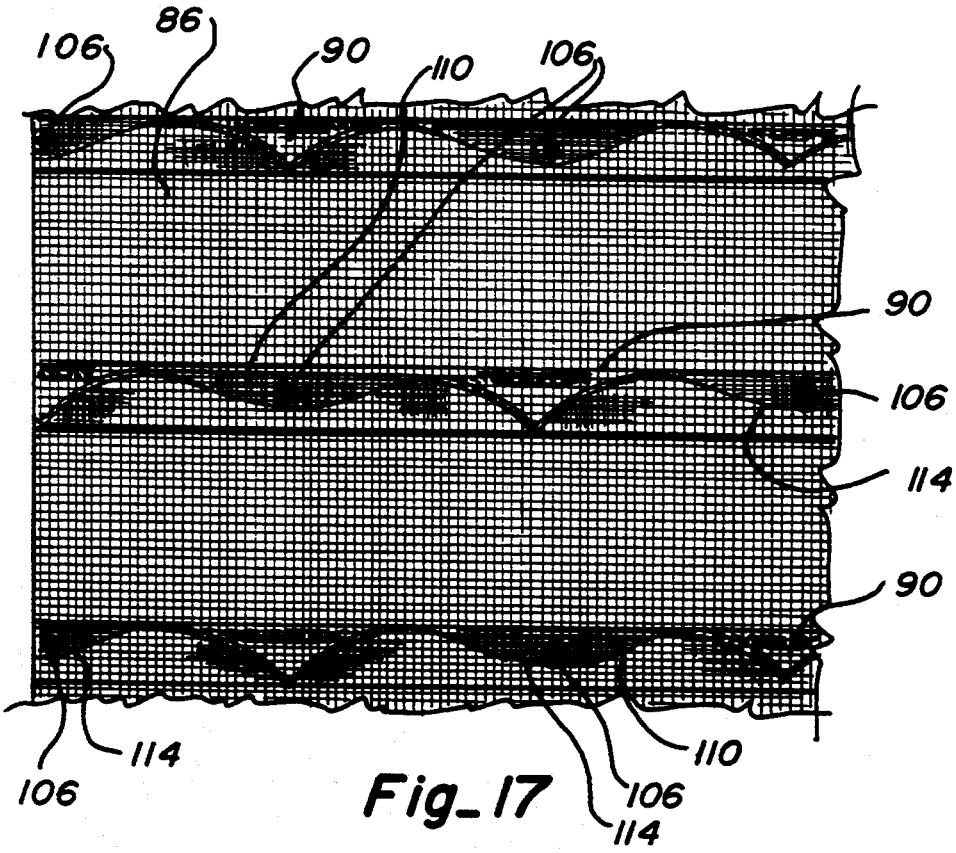
FIG. 17 is an enlarged view taken along line 17—17 of FIG. 16.
Figure 19:
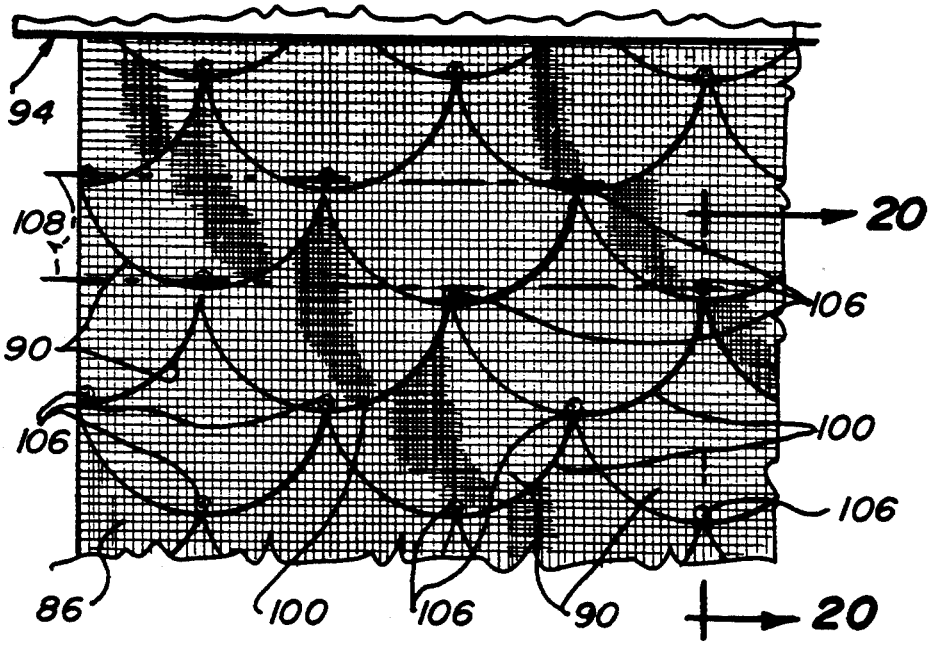
FIG. 19 is a fragmentary front elevation of the second embodiment of the window covering of the present invention in a closed position.
Figure 20:
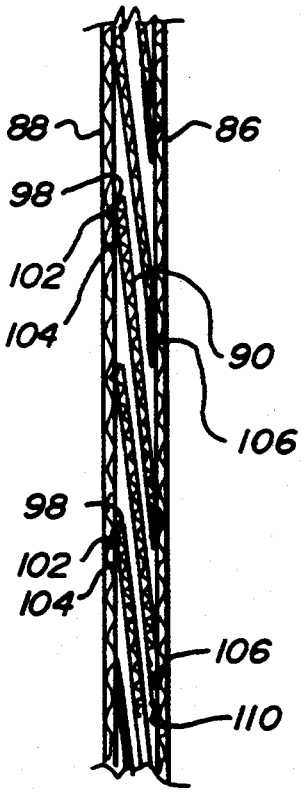
FIG. 20 is an enlarged fragmentary section taken along line 20—20 of FIG. 19.
Figure 21:
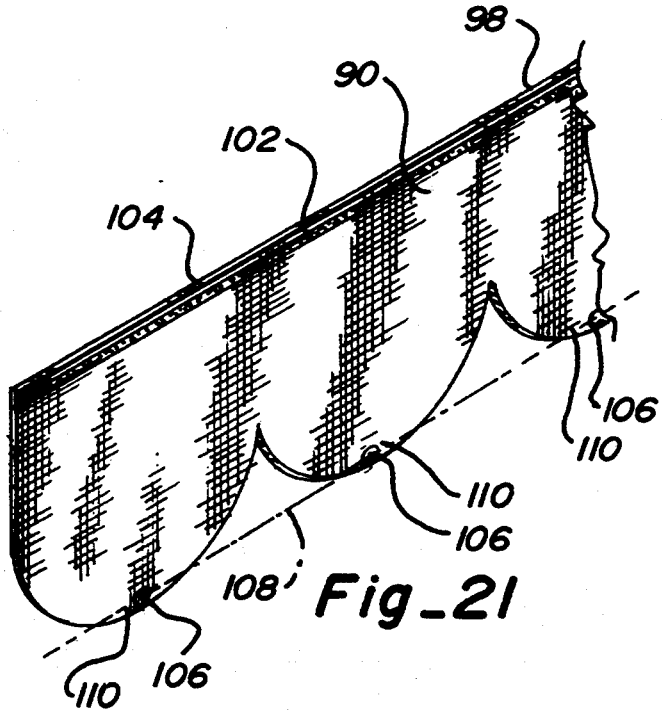
FIG. 21 is a fragmentary isometric showing a vane utilized in the second embodiment of the present invention as it appears in the closed position of the window covering.

Looking particularly at FIGS. 18 and 21, the vanes 90 can be seen to comprise elongated strips of fabric material which have one straight edge 98 and one scalloped edge 100. The vanes have a continuous line of adhesive 102 applied to the rear planar face 104 adjacent to the straight edge 98 and spots of adhesive 106 along a discontinuous line 108 (FIG. 21) on the front planar face 110 at points along the scalloped edge 100 defining the locations which are maximally spaced from the straight edge 98 of the vane. The region between the lines of adhesive may be referred to as the main portion of the vane.

The straight line of adhesive 102 along the rear planar face of each vane 90 is bonded to the rear sheet 88 of material while the spots of adhesive 106 on the front planar face of each vane along the scalloped edge 100 are bonded to the front sheet 86 of material. The vanes are positioned between the front and rear sheets so that the scallops are offset relative to the scallops of vertically adjacent vanes and the vanes are vertically spaced so that in the closed position of FIGS. 14 or 19, the vanes overlap each other so as to substantially block the passage of light through the window covering. Of course, as with the first embodiment, the vanes preferably have some degree of opacity while the front and rear sheets are transparent or translucent.

Figure 14:
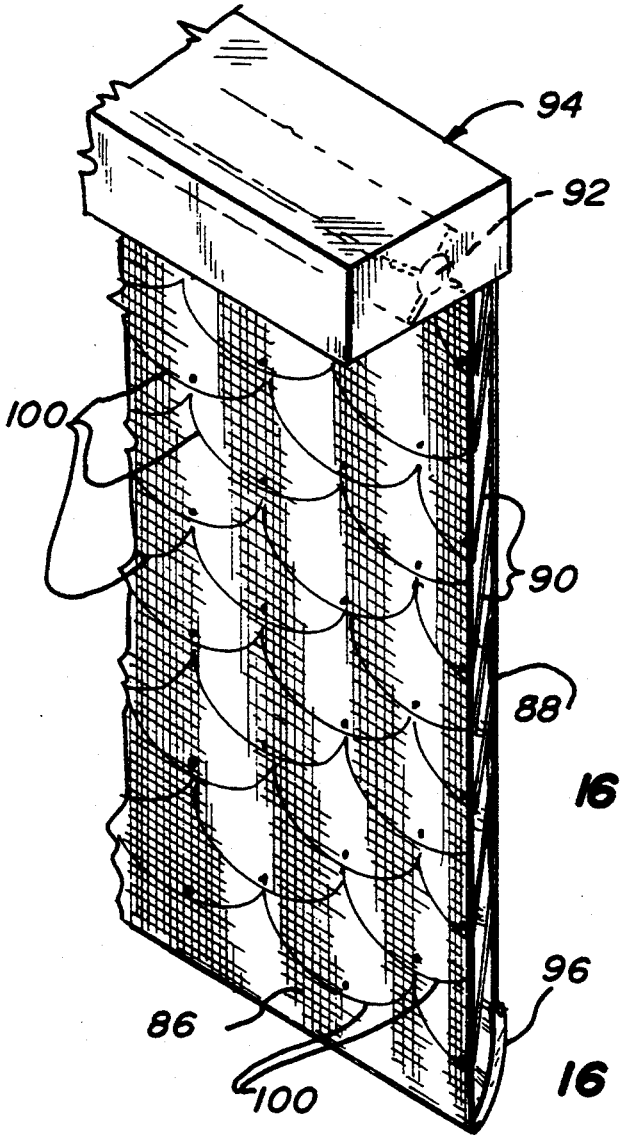
FIG. 14 is a fragmentary isometric view of a second embodiment of the present invention with the window covering in a closed position.
Figure 15:
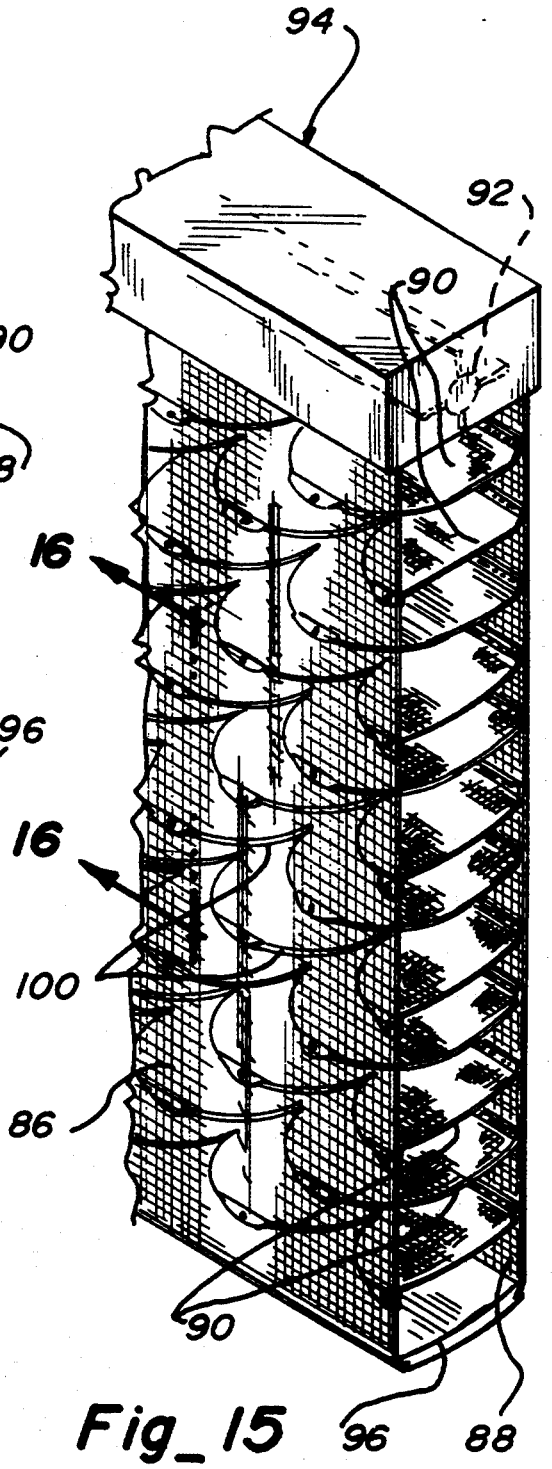
FIG. 15 is a fragmentary isometric view of the second embodiment of the present invention with the window covering in an open condition.
Figure 16:
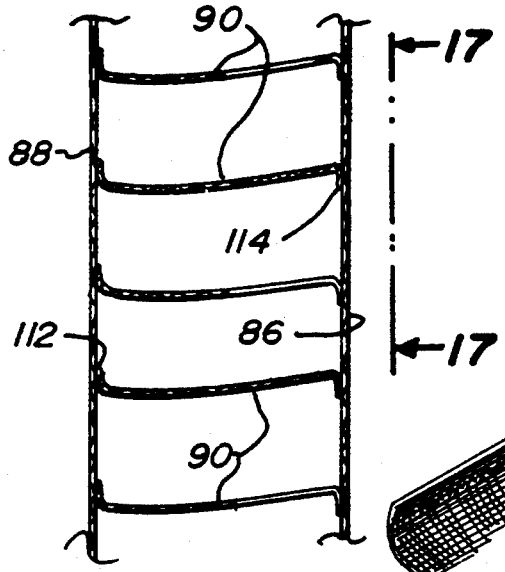
FIG. 16 is an enlarged fragmentary section taken along line 16—16 of FIG. 15.

As will be appreciated particularly by reference to FIGS. 14 and 15, the second embodiment of the window covering of the present invention has a quite distinct appearance to that of the first embodiment. The window covering in the closed condition of FIG. 14 shows overlapped scallops through the front sheet 86 while in the open condition of FIG. 15, the spots of adhesive 106 are more readily visible than the scalloped edge 100 of the associated vanes. It will also be appreciated that in the closed condition, the vanes assume a substantially planar configuration while in the open condition, the vanes are substantially planar except for up-turned and down-turned edges 112 and 114, respectively, along the straight edge 98 and the scalloped edge 100 respectively where the vanes are bonded to the sheets.

The second embodiment of the present invention might also be implemented by extending the vanes vertically rather than horizontally. The control mechanism for operating a vertical arrangement could be of the type disclosed in FIGS. 3 and 4 of U.S. patent application Ser. No. 07/810,331 filed Dec. 19, 1991 for Window Covering Assembly which is of common ownership with the present application and is hereby incorporated by reference.

Figure 22:
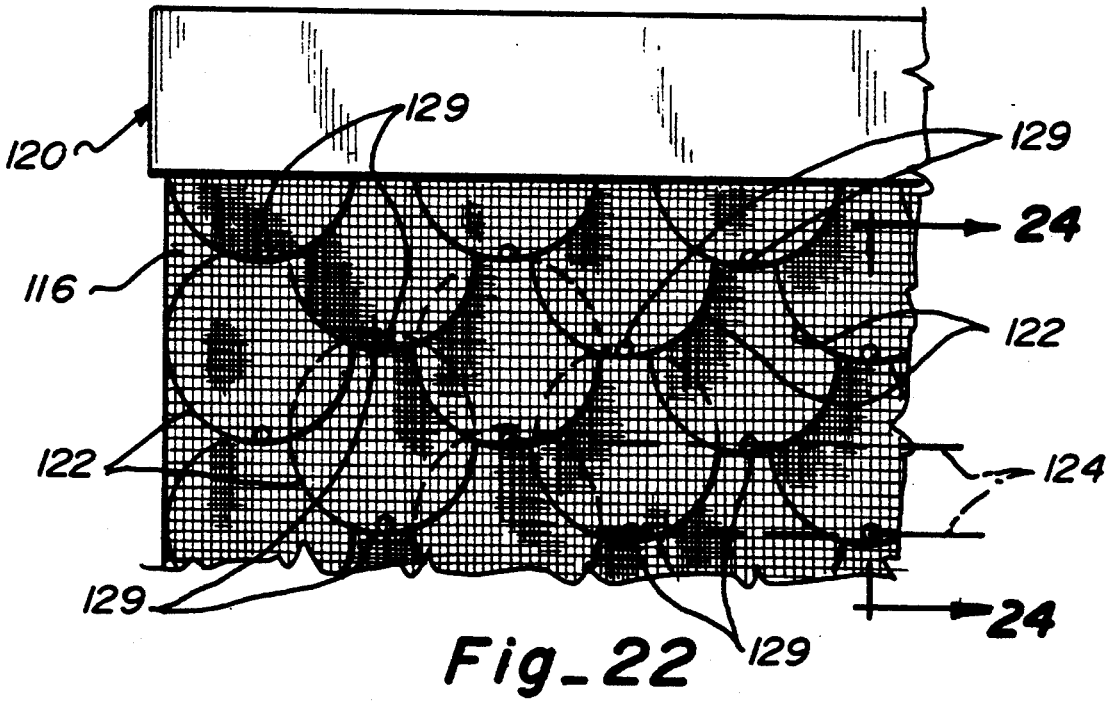
FIG. 22 is a fragmentary front elevation of a third embodiment of the present invention with the window covering in a closed position.
Figure 23:
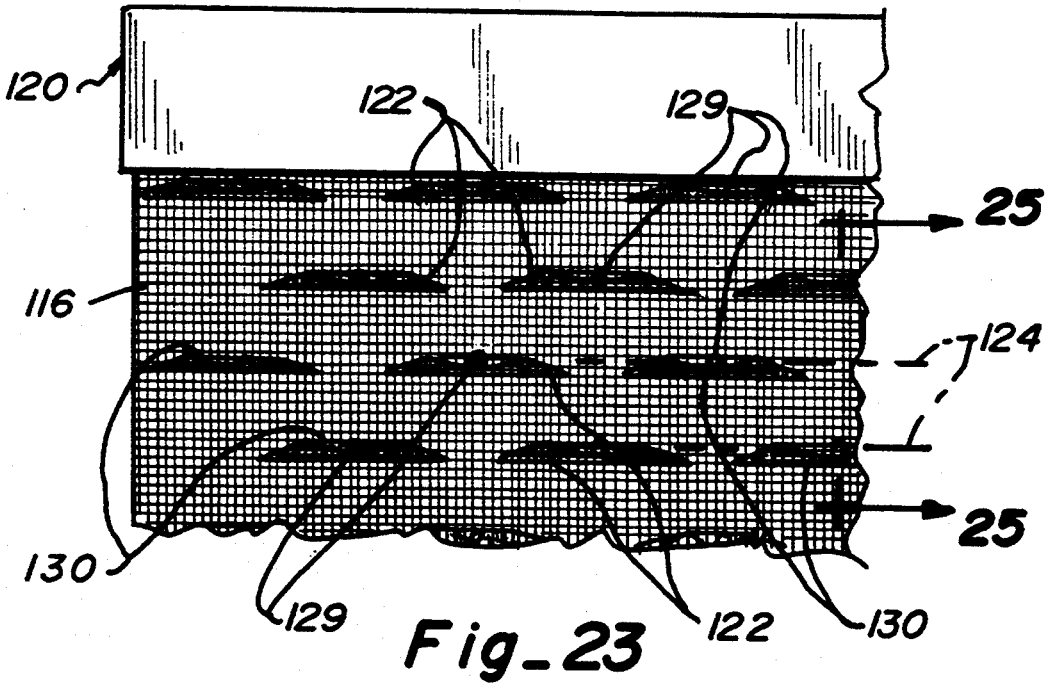
FIG. 23 is a fragmentary front elevation of the third embodiment of the present invention with the window covering in an open condition.
Figure 24:
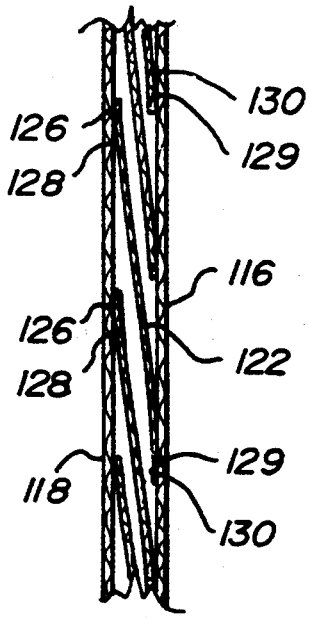
FIG. 24 is an enlarged fragmentary section taken along line 24—24 of FIG. 22.
Figure 25:
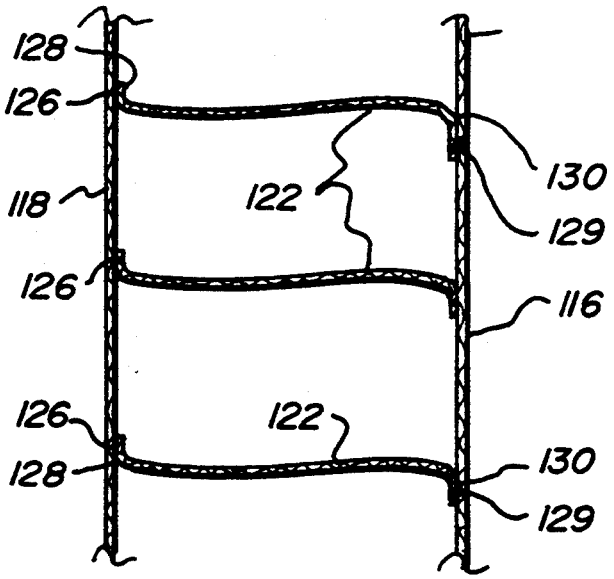
FIG. 25 an enlarged fragmentary section taken along line 25—25 of FIG. 23.
Figure 26:
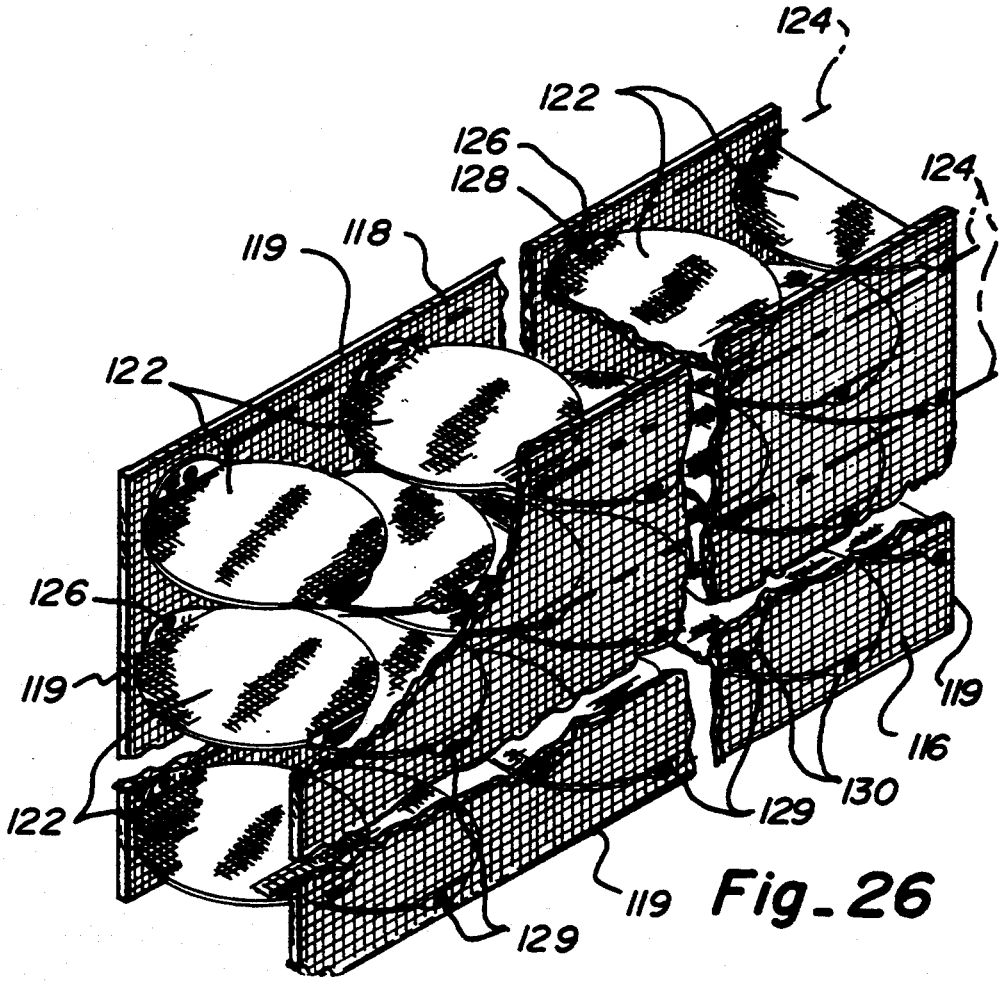
FIG. 26 is a fragmentary isometric showing the third embodiment of the window covering of the present invention in an open condition.

A first arrangement of a third embodiment of the present invention is shown in FIGS. 22 through 26 wherein front and rear quadrilateral translucent or transparent sheets 116 and 118, respectively, such as sheer, have two pairs of parallel side edges 119 (FIG. 26) and are suspended in parallel relation from a head rail 120 having a control system as in the first described embodiment and wherein a plurality of flexible vanes 122 interconnect the sheets. This embodiment is quite distinct from the first and second embodiments in that the vanes themselves, which are preferably opaque, are individual pieces of circular configuration attached between the sheets 116 and 118 in vertically spaced horizontal rows. It will be appreciated that the vanes have dimensions smaller than the distance between parallel sides 119 of the sheets 116 and 118. Each row of a plurality of vanes 122 is bonded to the front and rear sheets at spaced horizontal locations relative to the other rows and along discontinuous horizontal bond lines 124 (FIG. 26). The vanes in each row are staggered relative to the vanes in the next adjacent row and the rows of vanes are vertically spaced so that in the closed condition of the window covering as shown in FIG. 22, the vanes overlap each other so as to block the passage of light through the window covering. Depending upon the desired use and aesthetics of the window covering, however, the vanes might be designed and positioned so as not to overlap.

The vanes 122 have a spot of adhesive 126 on a rear planar face 128 thereof along the peripheral edge of the vane and a second spot of adhesive 129 on the front planar face 130 thereof at an opposite location along the peripheral edge of the vane so that the spot of adhesive 129 on the front face of the vane can be bonded to the front sheet 116 while the spot of adhesive 126 on the rear planar face 128 of the vane is bonded to the rear sheet 118. The region on each vane between the spots of adhesive may be referred to as the main portion of the vane. Of course, when the window covering is in the closed position of FIG. 22 or 24, the vanes assume a substantially planar orientation while in the open condition of FIGS. 23, 25 and 26, the vanes are substantially planar having an upturned and a down-turned edge adjacent to the rear sheet and the front sheet respectively where the vanes are bonded to the sheets. This embodiment of the invention creates an aesthetic appearance that is quite distinct from the first two embodiments while providing many of the utilitarian functions of the first two embodiments.

Figure 27:
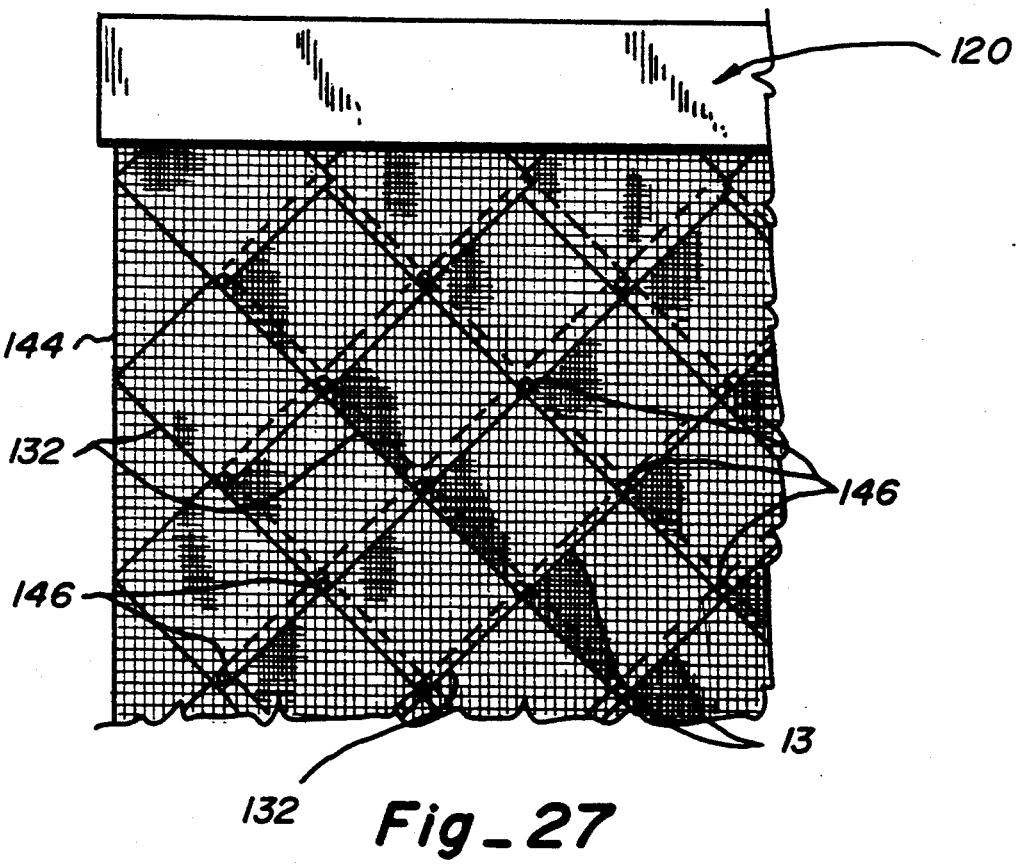
FIG. 27 is a fragmentary front elevation showing a different arrangement of the third embodiment of the present invention wherein vanes of a different geometric configuration are utilized and with the window covering in a closed position.
Figure 28:
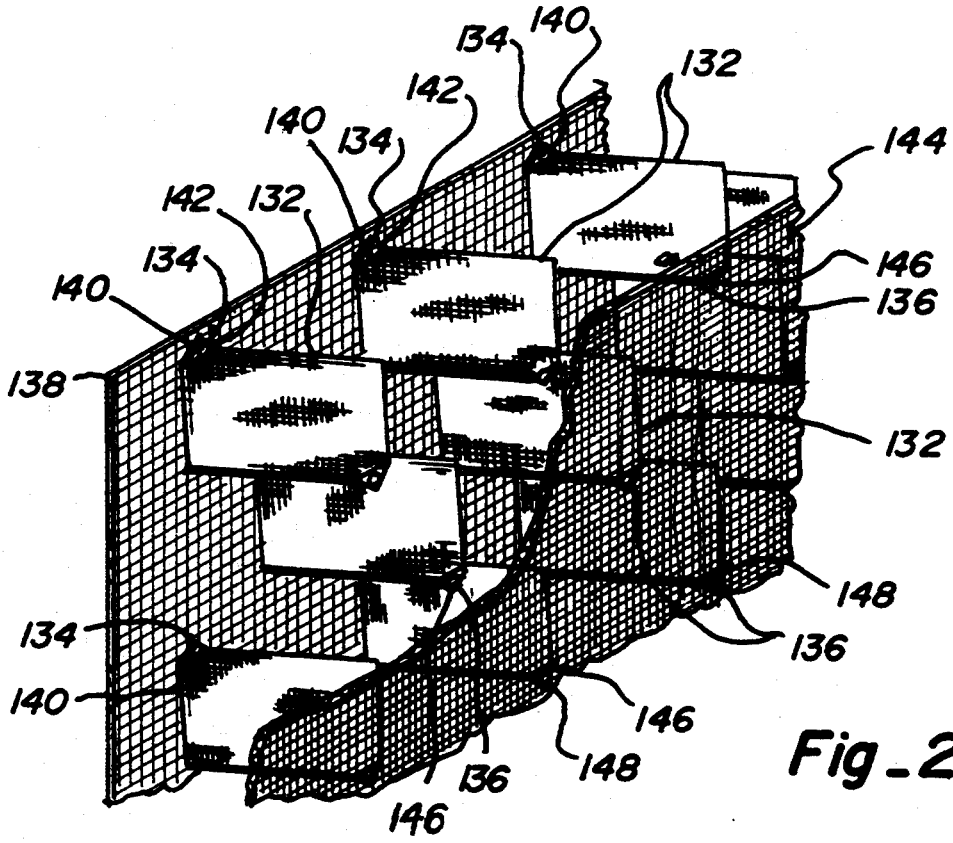
FIG. 28 is a fragmentary isometric of the window covering shown in FIG. 27 with the window covering in an open condition.

FIGS. 27 and 28 show an alternative arrangement of the third embodiment of the window covering of the present invention wherein the vanes 132 are of diamond shaped configuration as opposed to the circular configuration shown in the arrangement of FIGS. 22 through 26. It will be appreciated that the vanes in the third embodiment could assume numerous configurations, preferably, but not necessarily, different geometric forms, some of which will be described later. The vanes 132 are positioned in horizontal, vertically spaced rows and are staggered relative to the vanes in vertically adjacent rows so as to overlap when the window covering is in the closed condition of FIG. 27. In this arrangement, the vanes 132 in each row actually horizontally overlap each other to a small degree to assure the blockage of light through the window covering in the closed condition.

Each diamond shaped vane 132 has an upturned edge 134 at one corner and a down-turned edge 136 at the opposite corner with the upturned edge being bonded to the rear sheer 138 by a spot of adhesive 140 applied to the rear planar face 142 of the vane and the down-turned edge 136 being bonded to the front sheet 144 by a spot of adhesive 146 on the front planar face 148 of the vane.

Figure 29:
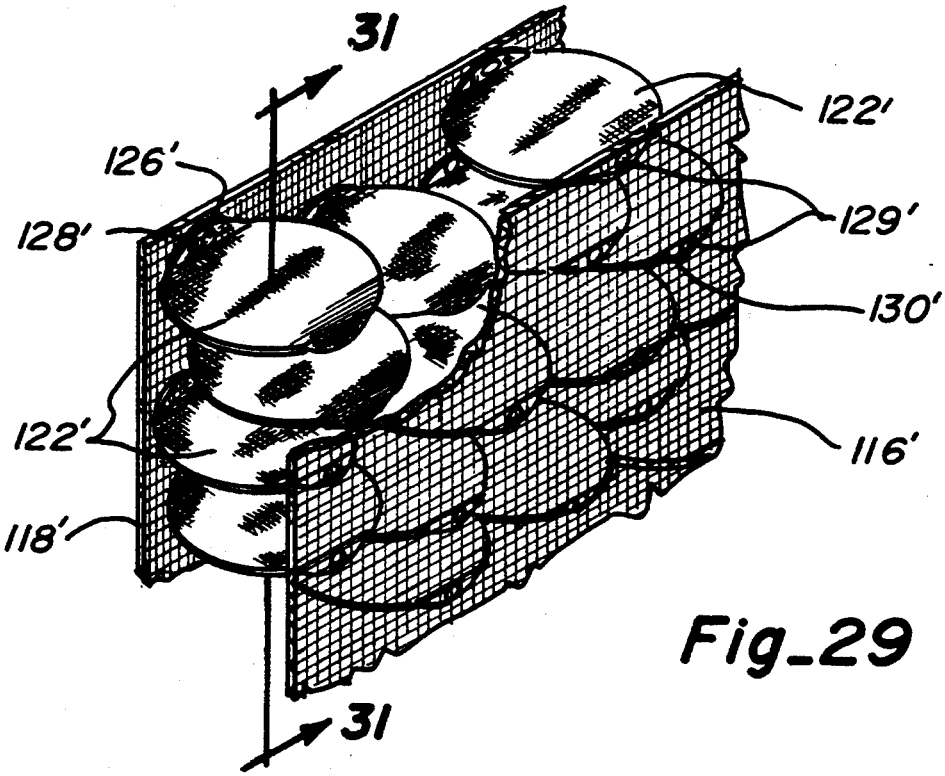
FIG. 29 is a fragmentary isometric of a third arrangement of the third embodiment of the present invention with the window covering in an open position and the vanes randomly positioned.
Figure 31:
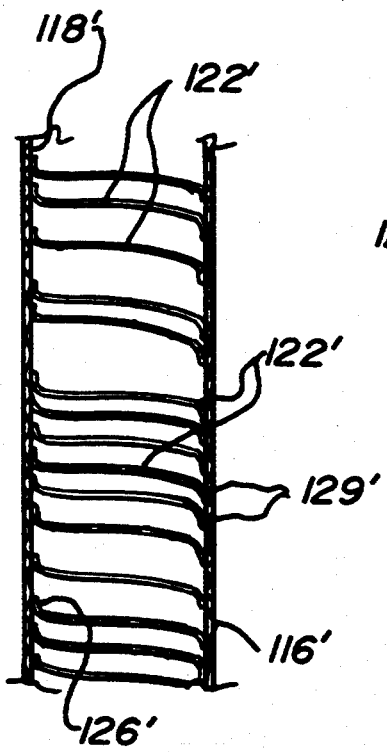
FIG. 31 is a fragmentary section taken along line 31—31 of FIG. 29.
Figure 30:
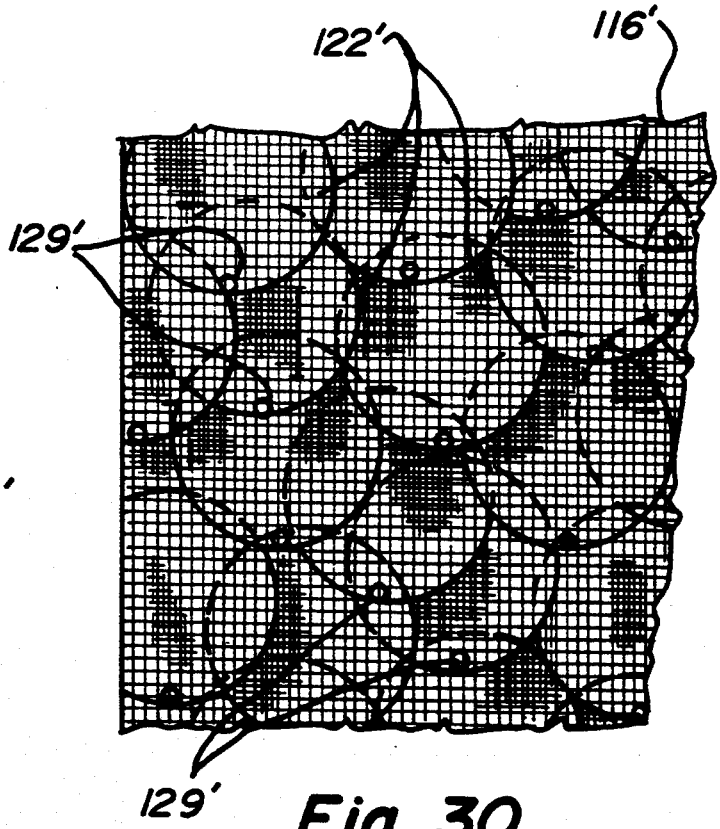
FIG. 30 is a fragmentary front elevation of the arrangement shown in FIG. 29 with the window covering in a closed position.

In another arrangement of the third embodiment of the window covering of the present invention wherein like parts have been given like reference numerals with a prime suffix (FIGS. 29–31), circular vanes 122' have a spot of adhesive 126' on a rear planar face 128' thereof along the peripheral edge of the vane and a second spot of adhesive 129' on the front planar face 130' thereof at an opposite location along the peripheral edge of the vane. Accordingly, the spot of adhesive 129' on the front face of the vane can be bonded to the front sheet 116' while the spot of adhesive 126' on the rear planar face 128' of the vane is bonded to the rear sheet 118'. In this arrangement, the vanes are not disposed in any particular pattern but rather are randomly oriented and may or may not overlap when the window covering is in the closed position of FIG. 30. As mentioned previously, depending upon the use and aesthetics desired for the window covering, the vanes may or may not overlap but the important distinction between this arrangement and the first-mentioned arrangement of the third embodiment is that the vanes are not mounted in horizontal or vertical rows but rather are randomly oriented.

Figure 32:
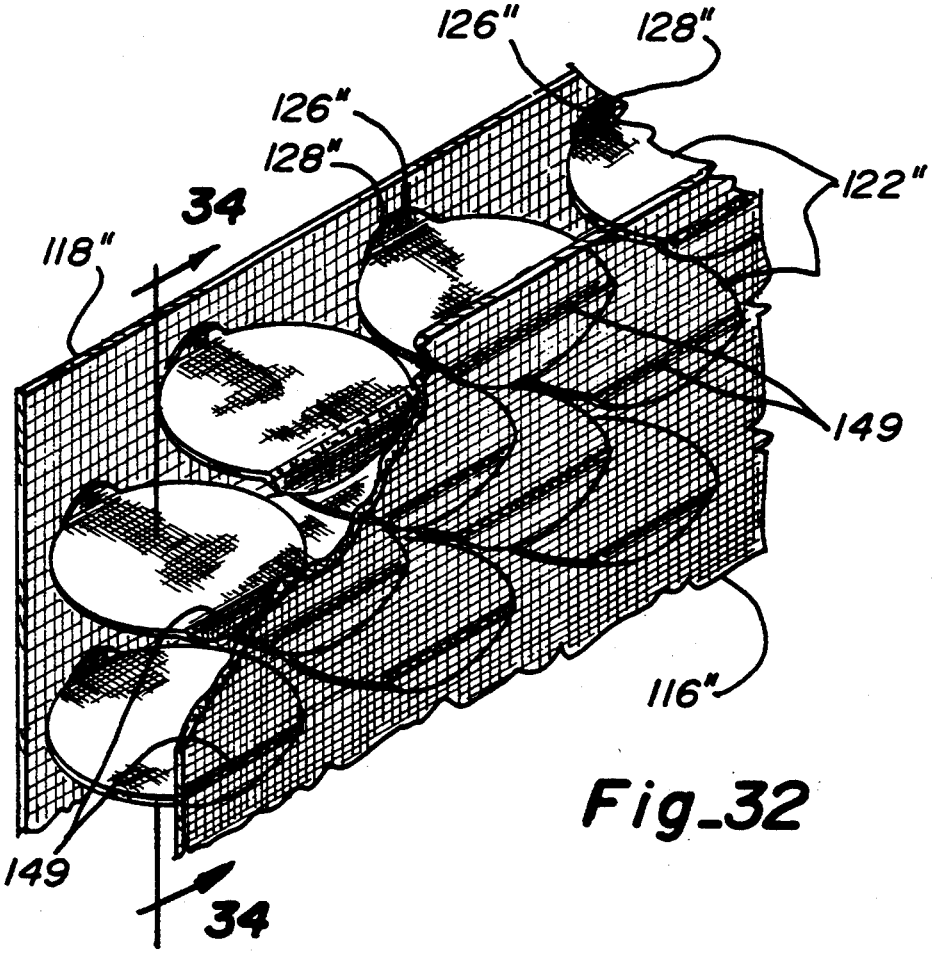
FIG. 32 is a fragmentary section of a fourth arrangement of the third embodiment of the present invention with the window covering in an open position.
Figure 34:
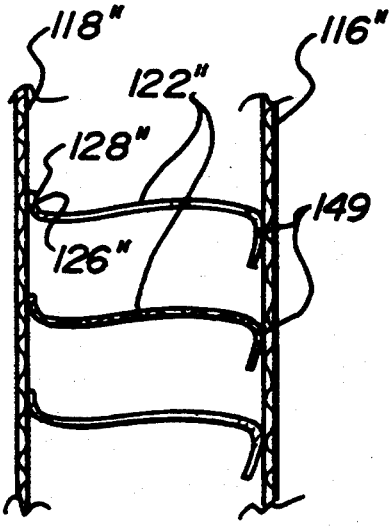
FIG. 34 is a section taken along line 34—34 of FIG. 32.
Figure 33:
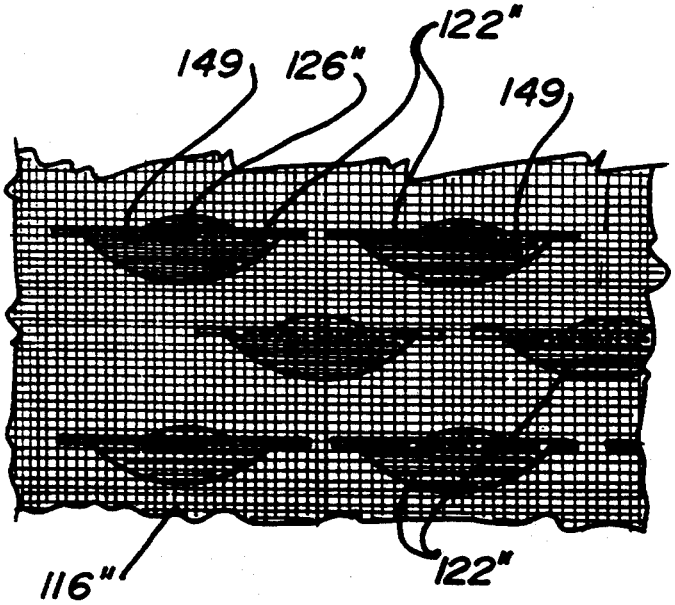
FIG. 33 is a fragmentary front elevation of the arrangement shown in FIG. 32.

Still another arrangement of the third embodiment of the present invention is shown in FIGS. 32–34 and like parts have been given like reference numerals with a double prime suffix. Vanes 122" have a spot of adhesive 126" on a rear planar face 128" thereof along the peripheral edge of the vane and near the opposite edge of the vane, a line of adhesive 149 is applied to the front face of the vane so as to separate the vane into a large main portion extending between the spot of adhesive 126" and the line of adhesive 149, and a smaller portion which hangs or extends in parallel relationship with the front sheet 116". As will be appreciated, the smaller portion of each vane is then visible through the front sheet regardless of whether or not the window covering is in the open or closed position.

Any arrangement of the third embodiment of the present invention might be implemented by extending the vanes vertically rather than horizontally. The control mechanism for operating a vertical arrangement could be of the type disclosed in FIGS. 3 and 4 of U.S. patent application Ser. No. 07/810,331 filed Dec. 19, 1991 for Window Covering Assembly which is of common ownership with the present application and is hereby incorporated by reference.

Figure 35:
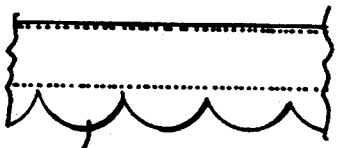
FIG. 35 is a fragmentary plan view of a vane utilized in the first embodiment of the present invention.
Figure 36:
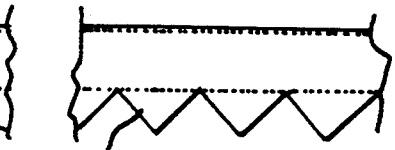
FIG. 36 is a plan view of a second arrangement of a vane usable in the first embodiment of the present invention.
Figure 37:
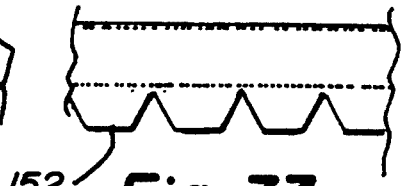
FIG. 37 is a plan view of still another arrangement of a vane usable in the first embodiment of the present invention.

FIGS. 35 through 37 show three distinct arrangements for vanes used in accordance with the first embodiment of the present invention with FIG. 35 showing the vane 56 having semi-circular arcuate scallops as shown in the arrangement illustrated in FIGS. 1 through 13. FIG. 36 shows a vane 150 with triangular shaped scallops while FIG. 37 shows a vane 152 with trapezoidal shaped scallops. It will of course be appreciated that many difference geometric or even non-geometric or non-uniform patterns could be formed along the scalloped edge of a vane to create any desired aesthetic appearance.

Figure 38:
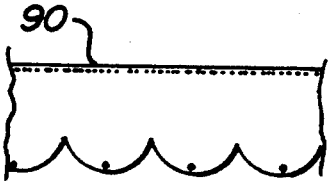
FIG. 38 is a plan view of a vane used in the second embodiment of the present invention.
Figure 39:
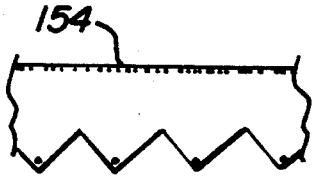
FIG. 39 is a plan view of another arrangement of a vane usable in the second embodiment of the present invention.
Figure 40:
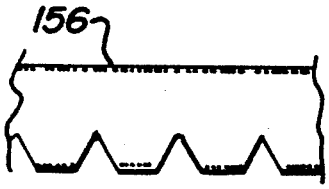
FIG. 40 is still another arrangement of a vane usable in accordance with the second embodiment of the present invention.

FIGS. 38 through 40 show variations of vanes used in the second embodiment of the window covering of the present invention with FIG. 38 illustrating a vane 90 with a scalloped edge having semi-circular arcuate scallops as shown in the arrangement illustrated in FIGS. 14 through 21. FIG. 39 illustrates a vane 154 with scallops of a triangular configuration while FIG. 40 shows a vane 156 with scallops of a trapezoidal configuration but again various geometric scalloped configurations could be utilized or even a non-geometric or a non-uniform edge to vary the appearance of the window covering.

Figure 41:
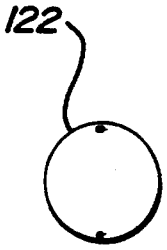
FIGS. 41–52 are plan views of various vane configurations usable in the third embodiment of the window covering of the present invention.
Figure 42:
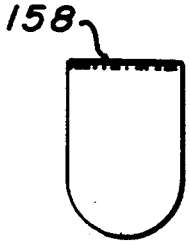

FIGS. 41 through 52 illustrate various configurations of vanes for use in the third embodiment of the window covering of the present invention with FIG. 41 showing circular vanes 122 as shown in the arrangement illustrated in FIGS. 22 through 26. FIG. 42 illustrates a vane 158 having a semi-circular side and a rectangular side so that one edge of the vane would be bonded to a rear sheet along a straight bond line while the opposite edge of the vane would be bonded to a front sheet at a spot location.

Figure 43:
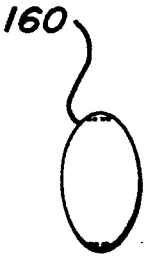

FIG. 43 illustrates an oval-shaped vane 160 having opposite spot locations for adhesive similarly to FIG. 41.

Figure 44:
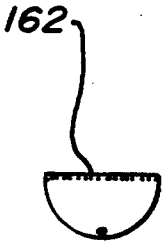

FIG. 44 shows a vane 162 of a semi-circular configuration so that one edge of the vane would be bonded along a straight line to a rear sheet and the opposite edge at a spot location to a front sheet.

Figure 45:
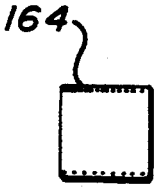

FIG. 45 shows a vane 164 of a square configuration which would be bonded to the front and rear sheets along straight lines defined by opposite side edges of the vane.

Figure 46:
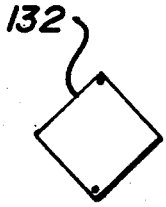

FIG. 46 shows the vane 132 configured as illustrated in FIGS. 27 and 28 in a diamond form.

Figure 47:
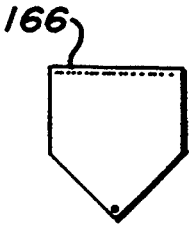

FIG. 47 illustrates a vane 166 of a pentagonal configuration having a triangle shape along one side and a rectangular shape on the opposite side. A vane of this configuration would be bonded to a rear sheet along a straight bond line and to a front sheet at a spot location at the tip of the triangle.

Figure 48:
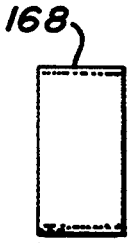

FIG. 48 shows a rectangularly shaped vane 168 which would be bonded to front and rear sheets along straight lines similarly to the square shaped vane of FIG. 45.

Figure 49:
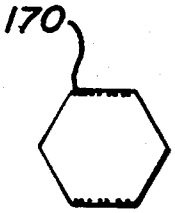

FIG. 49 is a hexagonally shaped vane 170 which would be oriented relative to the front and rear sheets so that it is bonded thereto along straight side edges of the vane.

Figure 50:
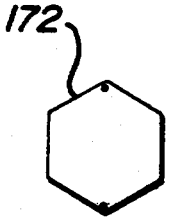

FIG. 50 illustrates a hexagonally shaped vane 172 which would be oriented so as to be bonded to front and rear sheets at spot locations at corners, of the vane.

Figure 51:
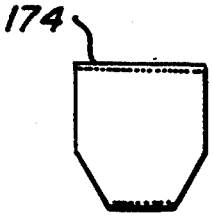

FIG. 51 shows another hexagonally shaped vane 174 wherein one end of the vane that is bonded to a front sheet is of trapezoidal configuration while the opposite side of the vane which would be bonded to a rear sheet is of rectangular configuration. Again, the connection of the vane to the sheets would be along straight lines.

Figure 52:
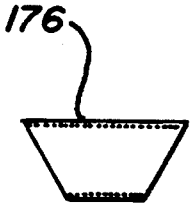

FIG. 52 shows a vane 176 of trapezoidal configuration with the bond lines being straight along opposite side edges of the vane.

It will be appreciated from the above description of the present invention that a window covering of the type having two spaced sheets of transparent or translucent material that are interconnected by a plurality of vanes has been disclosed in various embodiments and arrangements to provide the utilitarian functions of similar prior art window coverings while creating varied aesthetics. Many configurations of the vanes consistent with the disclosure can be envisioned. These configurations may encompass other geometric patterns than those disclosed or patterns that are non-geometric for any desired aesthetics.

Although the present invention has been described with a certain degree of particularity, it is understood that the present disclosure has been made by way of example, and changes in detail or structure may be made without departing from the spirit of the invention as defined in the appended claims.

We claim:

1. A window covering comprising in combination, a pair of non-opaque flexible sheets having first and second pairs of parallel side edges, a control system for suspending said sheets in a manner such that the sheets hang vertically and are selectively and reciprocally movable relative to each other in opposite directions, and a plurality of vanes interconnecting said sheets, said vanes having a main portion bridging the space between said sheets and wherein said vanes are formed in non-rectangular planar configurations such that the main portions of said vanes are movable along with the movement of said sheets between an open position wherein said main portion of each vane is substantially perpendicular to said sheets and a closed position wherein said main portion extends in substantially parallel relationship to said sheets.

2. The window covering of claim 1 wherein said vanes are elongated having longitudinal opposite side edges and a marginal area adjacent to one of said side edges separating said one side edge from said main portion, and wherein said vanes are secured to one of said sheets along a line separating said main portion from said marginal area whereby said marginal area can lie in continual parallel relationship to said sheets.

3. The window covering of claim 2 wherein said marginal area is non-rectangular in configuration.

4. The window covering of claim 3 wherein said marginal area is scalloped.

5. The window covering of claim 3 wherein the scallops are of geometric configuration.

6. The window covering of claim 5 wherein the scallops are of arcuate configuration.

7. The window covering of claim 5 wherein the scallops are of triangular configuration.

8. The window covering of claim 5 wherein the scallops are of trapezoidal configuration.

9. The window covering of claim 1 wherein said vanes are elongated having longitudinal side edges and wherein at least one side edge is non-linear and is connected to the adjacent sheet at spaced intervals along the length of said vanes.

10. The window covering of claim 9 wherein said non-linear side edge is scalloped.

11. The window covering of claim 10 wherein the scallops are of geometric configuration.

12. The window covering of claim 11 wherein the scallops are of arcuate configuration.

13. The window covering of claim 11 wherein the scallops are of triangular configuration.

14. The window covering of claim 11 wherein the scallops are of trapezoidal configuration.

15. The window covering of claim 1 wherein there are a plurality of vanes interconnecting said sheets along spaced lines.

16. The window covering of claim 15 wherein said vanes are of geometric configuration.

17. The window covering of claim 16 wherein each vane is of the same geometric configuration.

18. The window covering of claim 16 wherein each vane has a continuous peripheral side edge and a pair of points along said peripheral side edge positioned on opposite sides of said vane and on opposite faces of said vane, each of said points being connected to one of said sheets.

19. The window covering of claim 18 wherein said vanes along each of said spaced lines are uniformly spaced.

20. The window covering of claim 19 wherein the vanes along each of said spaced lines are staggered relative to the vanes in the next adjacent spaced lines.

21. The window covering of claim 20 wherein said vanes are sized to overlap when the window covering is in said closed position.

22. The window covering of claim 20 wherein said vanes are of circular planar configuration.

23. The window covering of claim 20 wherein said vanes are of oval planar configuration.

24. The window covering of claim 20 wherein said vanes are of semi-circular planar configuration.

25. The window covering of claim 20 wherein said vanes are of square planar configuration.

26. The window covering of claim 20 wherein said vanes are of rectangular planar configuration.

27. The window covering of claim 20 wherein said vanes are of diamond planar configuration.

28. The window covering of claim 20 wherein said vanes are of trapezoidal planar configuration.

29. The window covering of claim 20 wherein said vanes are of hexagonal planar configuration.

30. The window covering of claim 20 wherein said vanes are of pentagonal planar configuration.

31. The window covering of claim 20 wherein said vanes are shaped so as to have a semi-circular shape at one side and a rectangular shape at the other side.

32. The window covering of claim 20 wherein said vanes are shaped so as to have a triangular shape at one side and a rectangular shape at the other side.

33. The window covering of claim 20 wherein said vanes are shaped so as to have a trapezoidal shape at one side and a rectangular shape at the other side.

34. A window covering comprising in combination:

a pair of non-opaque flexible sheets having first and second pairs of side edges, a control system for suspending said sheets in a manner such that the sheets hang vertically and are selectively and reciprocally movable relative to each other in opposite directions, and a plurality of vanes interconnecting said sheets, said vanes having a main portion bridging the space between said sheets and wherein the vanes are of a size such that their dimensions are smaller than the distance between said side edges of the first and second pairs of side edges, the main portions of said vanes being movable along with the movement of said sheets between an open position wherein said main portion of each vane is substantially perpendicular to said sheets and a closed position wherein said main portion extends in substantially parallel relationship to said sheets.

35. The window covering of claim 34 wherein said vanes are of geometric configuration.

36. The window covering of claim 35 wherein each vane is of the same geometric configuration.

37. The window covering of claim 35 wherein each vane has a continuous peripheral side edge and a pair of points along said peripheral side edge positioned on opposite sides of said vane and on opposite faces of said vane, each of said points being connected to one of said sheets.

38. The window covering of claim 37 wherein said vanes interconnect the sheets along spaced lines and the vanes along each of said spaced lines are uniformly spaced.

39. The window covering of claim 38 wherein the vanes along each of said spaced lines are staggered relative to the vanes in the next adjacent spaced lines.

40. The window covering of claim 39 wherein said vanes are sized to overlap when the window covering is in said closed position.

41. The window covering of claim 39 wherein said vanes are of circular planar configuration.

42. The window covering of claim 39 wherein said vanes are of oval planar configuration.

43. The window covering of claim 39 wherein said vanes are of semi-circular planar configuration.

44. The window covering of claim 39 wherein said vanes are of square planar configuration.

45. The window covering of claim 39 wherein said vanes are of rectangular planar configuration.

46. The window covering of claim 39 wherein said vanes are of diamond planar configuration.

47. The window covering of claim 39 wherein said vanes are of trapezoidal planar configuration.

48. The window covering of claim 39 wherein said vanes are of hexagonal planar configuration.

49. The window covering of claim 39 wherein said vanes are of pentagonal planar configuration.

50. The window covering of claim 39 wherein said vanes are shaped so as to have a semi-circular shape at one side and a rectangular shape at the other side.

51. The window covering of claim 39 wherein said vanes are shaped so as to have a triangular shape at one side and a rectangular shape at the other side.

52. The window covering of claim 39 wherein said vanes are shaped so as to have a trapezoidal shape at one side and a rectangular shape at the other side.

* * * * *

UNITED STATES PATENT AND TRADEMARK OFFICE

CERTIFICATE OF CORRECTION

PATENT NO. : 5,419,385
DATED : May 30, 1995
INVENTOR(S) : David Vogel, et al.

It is certified that error appears in the above-indentified patent and that said Letters Patent is hereby corrected as shown below:

| | |
|---|---|
| Cover page [56] References Cited under Foreign Patent Documents | "24985 5/1963 Australia" should be –249985 5/1963 Australia--. |
| Cover page [56] References Cited under Foreign Patent Documents | Add --WO80/02712 12/1980 PCT Int'l Appl.--. |

Signed and Sealed this

Eighteenth Day of March, 1997

*Attest:*

*Attesting Officer*

BRUCE LEHMAN

*Commissioner of Patents and Trademarks*